United States Patent [19]

Jones et al.

[11] Patent Number: 4,487,538

[45] Date of Patent: Dec. 11, 1984

[54] BINDING MACHINES

[75] Inventors: Leonard W. N. Jones, Camberley; Ross Doughty, Weybridge, both of England

[73] Assignee: James Burn Bindings Limited, Surrey, England

[21] Appl. No.: 354,802

[22] Filed: Mar. 4, 1982

[30] Foreign Application Priority Data

Apr. 14, 1981 [GB] United Kingdom ..... 8111808

[51] Int. Cl.[3] ..... B42C 1/12; B42C 11/02

[52] U.S. Cl. ..... 412/39; 412/7; 412/42

[58] Field of Search ..... 412/11, 12, 13, 33, 412/34, 39, 7, 10, 37

[56] References Cited

U.S. PATENT DOCUMENTS

| | | | |
|---|---|---|---|
| 2,266,171 | 12/1941 | Davis | 410/10 X |
| 3,334,918 | 8/1967 | Pigna et al. | 412/7 X |
| 3,667,076 | 6/1972 | Aglaghanian | 412/39 |
| 3,883,916 | 5/1975 | Adams | 412/39 |
| 4,020,516 | 5/1977 | Gomez | 412/39 |
| 4,031,585 | 6/1977 | Adams | 412/39 |
| 4,155,134 | 5/1979 | Pfaffle | 412/7 |

*Primary Examiner*—R. L. Spruill
*Assistant Examiner*—Paul M. Heyrana, Sr.
*Attorney, Agent, or Firm*—Wood, Herron & Evans

[57] ABSTRACT

In a binding machine for binding packets of perforated sheets together by means of pronged wire binding elements, the elements being fed as an open pronged binding strip from a toothed wheel to a toothed feed chain along a path, the strip being guided between the wheel and chain by a guide having guide surfaces which converge so that the open prongs of the strip are guided without deformation of the strip between the wheel and chain no matter what size of strip is being fed.

9 Claims, 4 Drawing Figures

BINDING MACHINES

The present invention relates to machines for binding packets of perforated sheets to book form with wire binding elements each formed from a length of metal wire bent to form a series of curved hairpin-shaped prongs on which the sheets are impaled and which are brought to ring shape by bringing their closed ends or "points" into the vicinity of their open ends or "roots". Such machines will be referred to herein as "binding machines of the kind set forth".

In our G.B. Pat. No. 1,460,444 there is shown a binding machine of the kind set forth. In this machine a wire binding strip is fed from a reel to a toothed drive wheel after which the strip is engaged by a chain which feeds the strip to a binding station. At this stage the binding strip is cut into lengths to form individual binding elements. A problem encountered in binding machines of the kind set forth is to accurately control the binding strip so that it reaches the binding station as accurately aligned with the feed mechanism as is possible. It will be appreciated that the nature of the binding strip is difficult to handle mechanically when in its open position and may be subject to imperfections of shape. The transfer between the feed wheel and feed chain has given rise to problems of location.

A machine of the kind set forth in accordance with the invention comprises a toothed feed wheel and a toothed feed chain arranged to feed a binding strip to a binding station, a guide between the wheel and chain, the guide having guide surfaces arranged to engage between the open ends of the binding strip, the guide surfaces converging so that when the binding strip is fed along the guide the converging sides are within the open ends of the binding strip.

In order to enable different sizes of the binding strips to be accommodated in the binding machine, the guide has a stepped cross section. In theory the cross section could be somewhat parabolic in shape but this would be more difficult to a machine than the stepped conformation.

At the end of the guide furthest from the feed wheel at a position where the toothed feed chain is arranged to engage with the binding strip a movable guide element may be provided between the guide surfaces, which guide element may be resiliently urged to press the binding strip onto the feed chain.

The toothed feed chain is preferably formed with notched teeth, the notches of which are arranged to engage with the binding strip. These teeth are suitably formed of a resilient material such as nylon which grips the binding strip securely. A further longitudinal notch may be provided in the feed chain teeth into which is arranged to engage a second guide extending along the length of the chain at least a part of the length of the chain between the feed wheel and the binding station. The second guide is preferably provided with converging guide surfaces which converge towards the feed chain. These guide surfaces may be planar since the binding strip is stabilized by its seating in the feed chain in the notched feed teeth.

An example of a machine in accordance with the invention is shown in the accompanying drawings in which.

Figure 1:
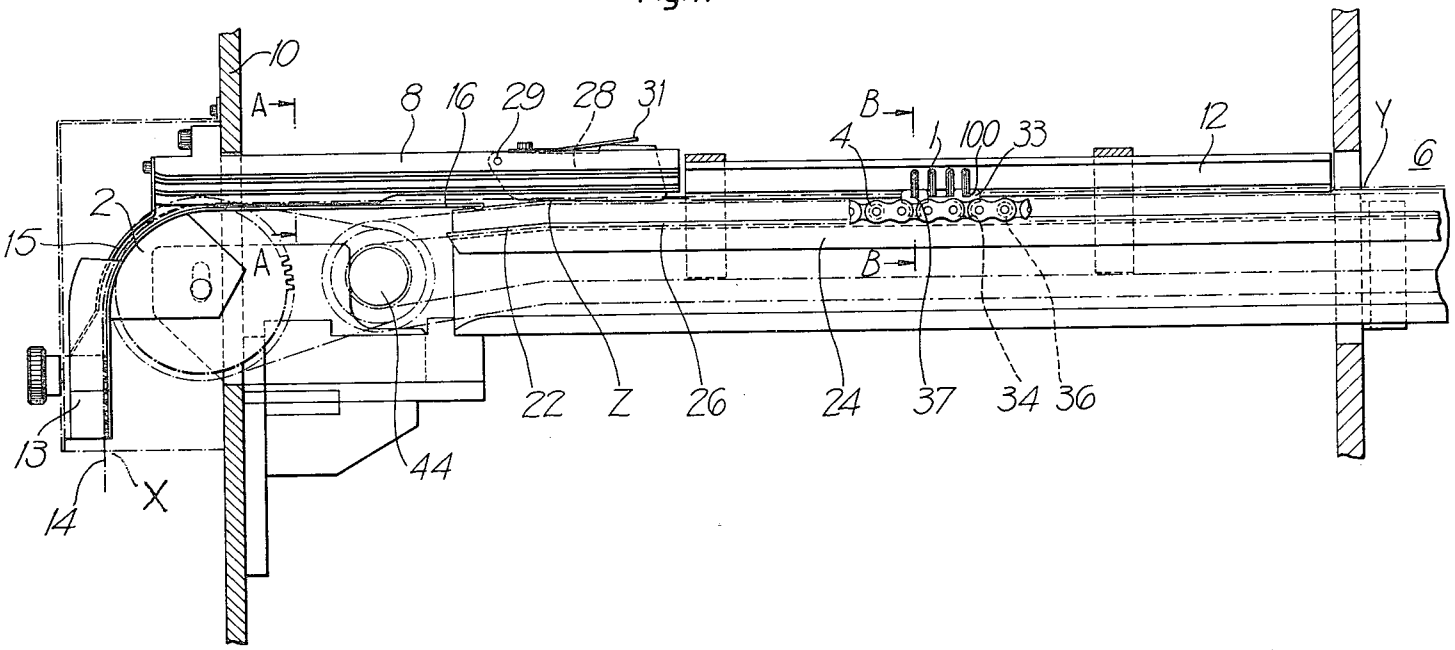
FIG. 1 is a side elevation of the machine.
Figure 2:
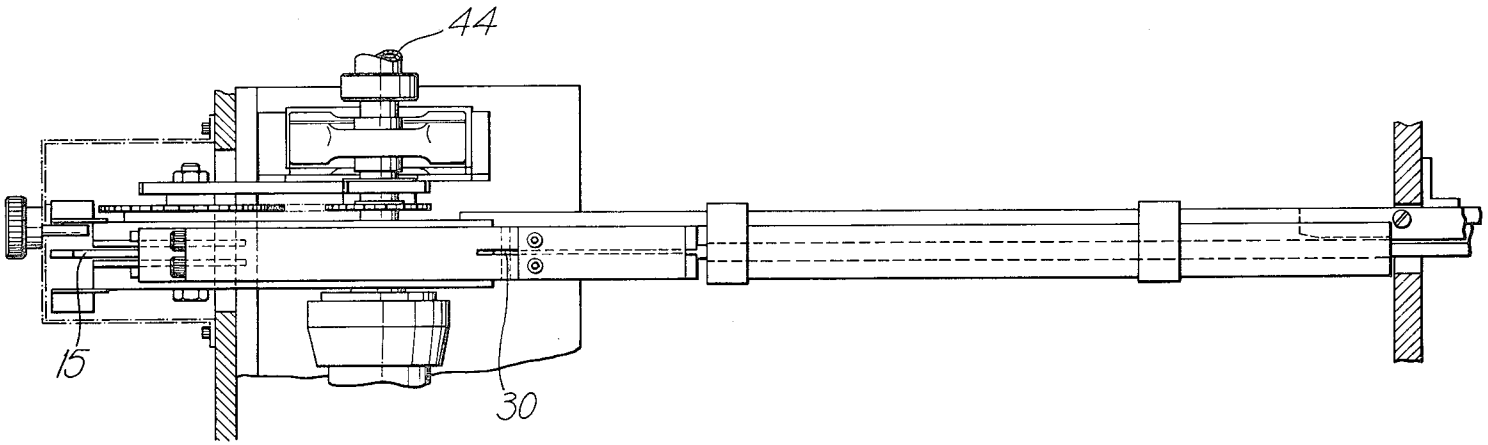
FIG. 2 is a plan view of the machine of FIG. 1.
Figure 4:
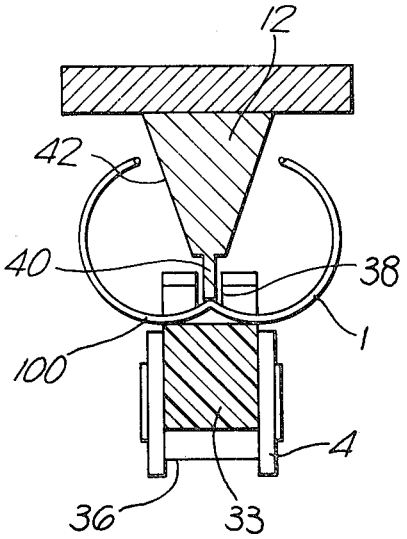
FIG. 4 is a cross-section of a second guide taken at B—B in FIG. 1.

The machine shown in the drawings is designed to handle a wire strip of the kind shown and described in G.B. Pat. No. 1,460,444. Part of the strip is shown at 1 (see FIGS. 1 and 4).

The machine comprises a toothed feed wheel 2 and a toothed feed chain 4 arranged to feed the binding strip 1 to a binding station 6. A first guide 8 is mounted on a frame 10 between the feed wheel 2 and the feed chain 4. A second guide 12 is mounted above the chain 4 between the first guide 8 and the binding station 6. The binding strip 1 follows a dot-dash line 14 from an entry point X to an exit point Y at the binding station 6 where it is cut into indivdual lengths to form binding elements.

Between entry point X and feed wheel 2 a feeder 13 guides the strip 1 under an arcuate spring 15 mounted at one end to guide 8 and over wheel 2. The strip 1 then passes along guide 8 over a plate 16.

Figure 3:
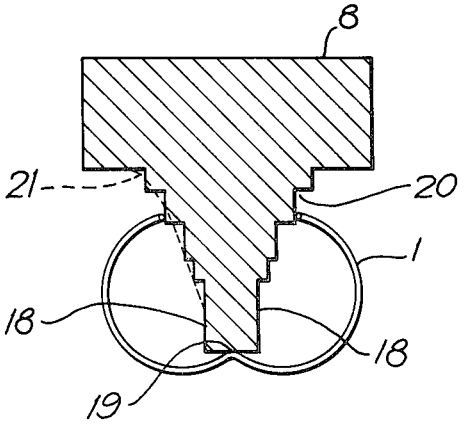
FIG. 3 is a cross-section of a first guide taken at A—A in FIG. 1.

In FIG. 3 it will be seen that guide 8 has guide surfaces 18 which converge at a lower or bottom surface 19. These guide surfaces are so formed in steps that they have lands which are spaced apart and distanced from the bottom surface 19 according to the size of binding element. The stepped form could be replaced by a continuous curved surface indicated by dashed line 21 but this would be difficult to machine accurately.

The strip is then fed to a point Z where the chain 4 initially passing up an inclined surface 22 of chain guide 24 assumes a horizontal path along horizontal surface 26. At point Z a guide element pivotally mounted at 29 in a slot 38 in the guide 8 and urged towards the chain by leaf spring 31 pushes the strip onto the chain and ensures the base portions 100 of the strip engage snugly in nylon teeth 33 on the chain.

The teeth 33 are formed with curved retaining surfaces 34 which engage between the chain link sleeves 36, and each tooth has a transverse strip retaining slot 37 and a longitudinal guide slot 38. The guide slots 38 cooperate with a guide portion 40 extending downwards from second guide 12. Guide 12 has converging planar sides or guide surfaces 42 which converge toward the chain and normally do not contact the strip which is substantially clamped between the guide portion 12 and the teeth 33.

The wheel 2 and chain 4 are driven from a common shaft normally driven by an electric motor (not shown) but which motor can be unclutched so that when initially feeding the strip into the machine this can be done by hand. In this way initial engagement by wheel 2 and chain 4 can be ensured manually. Thereafter the motor can be clutched in and the strip is fed without further manual adjustment to the binding station.

I claim:

1. A feed device for a wire binding element used in binding packets of perforated sheets together, said element being formed from a length of metal wire bent to form a series of curved hairpin-shaped prongs and having a longitudinal slot from one end thereof to the other, and said element being adapted to receive said sheets in impaled relation prior to closing said element into binding relation with said packet at a binding station, said feed device comprising a toothed feed wheel and a toothed endless chain, said wheel and chain cooperating to feed said element to said binding station along a feed path between said wheel and said binding station, an elongate guide located adjacent and parallel to that portion of said path between said wheel and said chain, said elongate guide being formed with opposite guide surfaces which converge toward one another, said elongate guide being oriented relative to said path so that said guide extends into said longitudinal slot of said element for guiding said element's prongs as said element moves between said wheel and said chain, and said convergent guide surfaces of said elongate guide being configured and sized to accommodate and to guide more than one size binding element, a further guide substantially parallel to said path, and spring means connected with said further guide, said spring means being adapted to urge said further guide toward said toothed chain for aid in interengagement of said element and said toothed chain.

2. A feed device as set forth in claim 1, each of said guide surfaces of said elongate guide comprising a series of steps that form spaced apart lands.

3. A feed device as set forth in claim 1, each of said guide surfaces of said elongate guide comprising a continuous curved surface.

4. A feed device as set forth in claim 1, said device comprising an additional guide positioned parallel to said chain along another portion of said path, said additional guide cooperating with said chain to ensure retention of said element in seated relation on said chain as said element is moved by said chain toward said binding station.

5. A feed device as set forth in claim 1, each of said chain teeth comprising at least a pair of outstanding tooth portions, said tooth portions cooperating to define a transverse slot therebetween for aid in seating said binding strip on said chain.

6. A feed device as set forth in claim 4, each of said chain teeth comprising four outstanding tooth portions, said tooth portions cooperating to define said transverse slot and a longitudinal guide slot, said additional guide being configured to extend into said longitudinal slots of said teeth as said chain passes said additional guide for aid in retaining said binding strip on said chain.

7. A feed device as set forth in claim 5, each of said chain teeth comprising two oppositely curved retaining surfaces, said retaining surfaces being engaged between adjacent link sleeves of said chain, thereby connecting each tooth to said chain.

8. A feed chain for a wire binding element used in binding packets or perforated sheets together, said element being formed from a length of metal wire bent to form a series of curved hairpin-shaped prongs and having a longitudinal slot from one end to the other, said element being adapted to receive said sheets in impaled relation prior to closing said element into binding relation with said packet at a binding station, and said feed chain operating to move said element toward said binding station, said feed chain comprising a plurality of laterally spaced apart pairs of links, said links being connected by link pins, a cylindrical sleeve mounted on each link pin between said pairs of links, and a plurality of tooth elements connected with said links, each tooth having a chain engaging portion formed with opposed retaining surfaces with each retaining surface being curved to a curvature corresponding approximately to the exterior cylindrical curvature of said sleeves, said chain engaging portion being sized so that it is trapped between adjacent sleeves for connecting said tooth with said chain, and each tooth also having a binding strip engaging portion extending outwards from the chain engaging portion, said strip engaging portion being adapted to receive a part of said binding element in seated relation thereon, said binding strip engaging portion comprising four outstanding tooth portions, said tooth portions cooperating to define a transverse slot and a longitudinal slot at right angles to said transverse slot, said transverse slot being for aid in seating said binding strip on said chain, and said longitudinal slot being for aid in retaining said binding strip in seated relation on said chain through use of a guide element extendable into said longitudinal slot.

9. A feed chain as set forth in claim 8, said binding strip engaging portion comprising at least a pair of outstanding tooth portions, said tooth portions cooperating to define a transverse slot therebetween for aid in seating said binding strip on said chain.

* * * * *